US005375803A

United States Patent [19]

Kump

[11] Patent Number: 5,375,803

[45] Date of Patent: Dec. 27, 1994

[54] HOLDER FOR PLANAR MATERIAL

[75] Inventor: Daniel J. Kump, Mentor, Ohio

[73] Assignee: Fasteners for Retail, Inc., Cleveland, Ohio

[21] Appl. No.: 130,119

[22] Filed: Sep. 30, 1993

[51] Int. Cl.[5] ..... A47B 96/06

[52] U.S. Cl. ..... 248/231.8; 24/453; 40/666; 211/57.1

[58] Field of Search ..... 248/231.8, 220.2, 221.4; 211/57.1, 45; 24/453, 487, 336; 40/666, 663, 668

[56] References Cited

U.S. PATENT DOCUMENTS

| | | | |
|---|---|---|---|
| 1,166,119 | 12/1915 | Fassen | 40/666 |
| 1,198,826 | 9/1916 | Dansereau | 40/663 |
| 3,324,585 | 6/1967 | Frederickson . | |
| 3,526,935 | 9/1970 | Boyce et al. | 211/45 |
| 3,797,143 | 3/1974 | Miller . | |
| 4,538,766 | 9/1985 | Fast . | |
| 4,556,183 | 12/1985 | Greenberger | 248/221.4 |
| 4,557,064 | 12/1985 | Thompson . | |
| 4,693,441 | 9/1987 | Conway | 248/221.4 X |
| 4,718,627 | 1/1988 | Fast et al. | 248/220.3 X |
| 4,807,334 | 2/1989 | Blanchard | 24/487 |
| 5,189,766 | 3/1993 | Weber | 24/453 X |

*Primary Examiner*—Ramon O. Ramirez

*Attorney, Agent, or Firm*—Fay, Sharpe, Beall, Fagan, Minnich & McKee

[57] ABSTRACT

A holder for planar or sheet material includes a first panel, a second panel and a hinge along which an edge of the first panel is secured to an edge of the second panel. A first prong is secured to the first panel and extends in a direction substantially normal thereto. A first aperture is provided in the second panel. The first prong of the first panel is so located and sized as to pass through an associated planar material and enter the first aperture of the second panel when the first panel is rotated along the hinge so that the first panel overlies a portion of the second panel. The planar material is thereby held between the first and second panels. The first prong can be selectively secured in the second panel or detached therefrom so as to selectively hold planar or sheet material in the holder. The holder can support a sign in an in-store display environment. The holder may also be useful in securing several sheets of material together or in securing a dispenser to the front edge of a shelf.

23 Claims, 3 Drawing Sheets

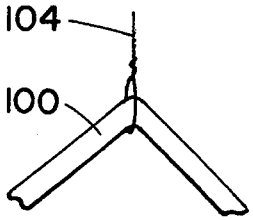
FIG. 5B
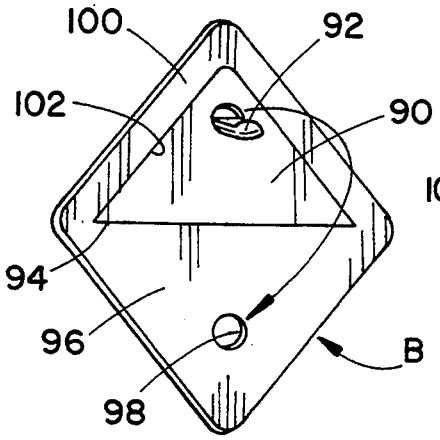
FIG. 5A
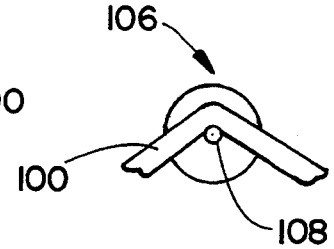
FIG. 5C
FIG. 6
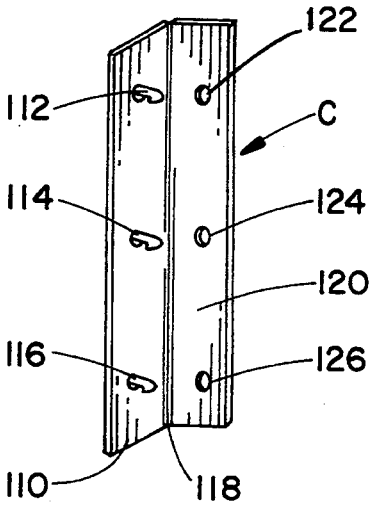
FIG. 7
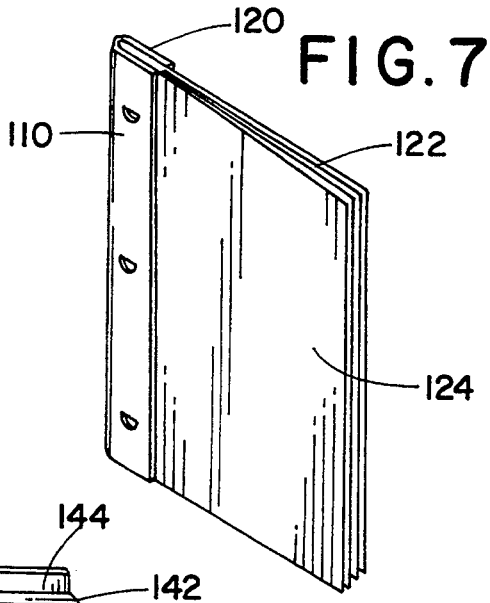
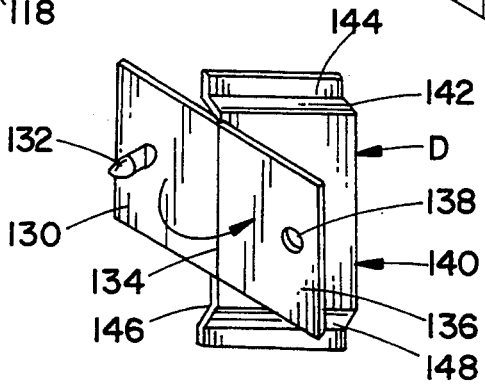
FIG. 8

FIG. 9
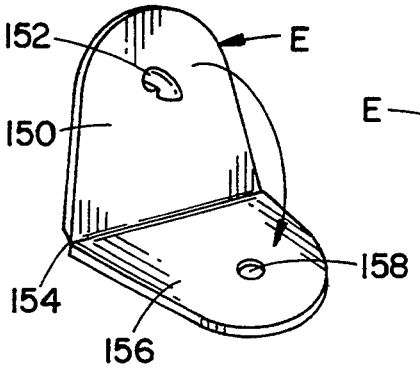
FIG. 10
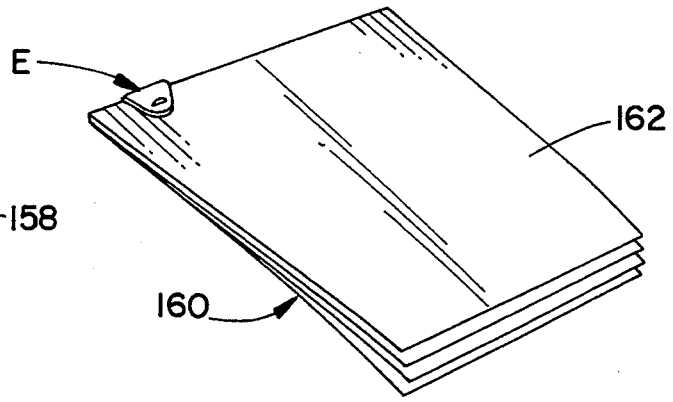
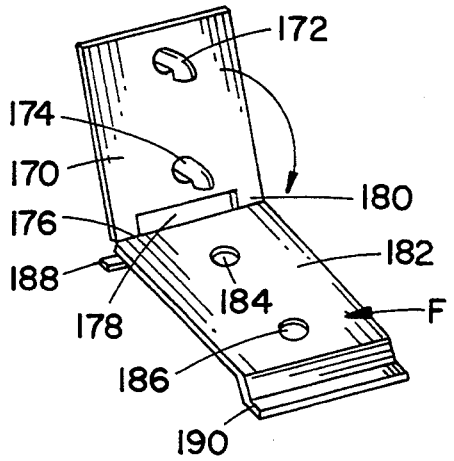
FIG. 11
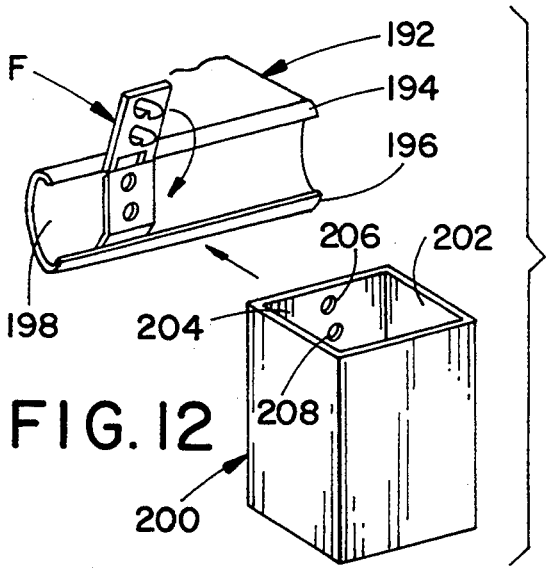
FIG. 12
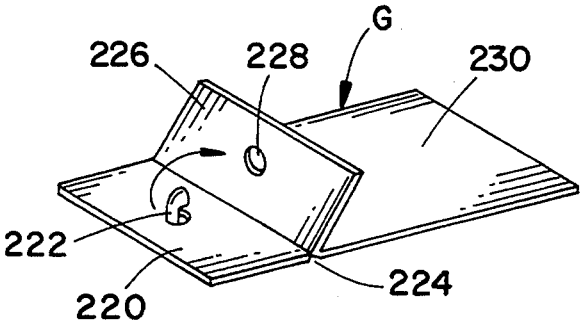
FIG. 13
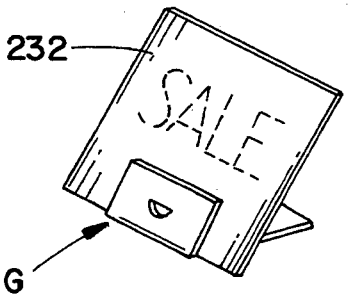
FIG. 14

HOLDER FOR PLANAR MATERIAL

BACKGROUND OF THE INVENTION

This invention relates generally to holders. More specifically, the present invention relates to a holder for planar or sheet material wherein the holder has a pair of hingedly connected panels and a prong on one panel which is adapted to pass through a hole in the other panel.

The invention is particularly applicable to holders or display devices useful in a retail environment where price sheets and the like need to be displayed to purchasers. However, it should be appreciated by those skilled in the art that the invention has broader applications and may also be adapted for use in many other environments such as holding a plurality of sheets together or holding a display fixture.

It is conventional practice in retail establishments to indicate the price of merchandise held on shelves with price sheets held to the shelf by some sort of clip. The price sheet may be positioned in a plane parallel to the shelf front edge or in a plane perpendicular to the front edge to call the buyer's attention to the goods.

It is desirable that sheets be mounted securely to prevent accidental or mischievous dislodgment. Previously known clips accomplished this through mechanical locking means, for example, a pin and slot arrangement or gripping teeth which prevent the removal of the sheet except by manually disengaging the locking means. Some such clips are made from several parts to facilitate the removal of sheets. However, such devices are more costly to produce than a one piece device.

A known one-piece clip includes first and second panels that are resiliently connected by a bight. The clip member has sufficient inherent resiliency so that the panel portions are normally biased into a confronting relationship with each other. One of the panel members has a lance which extends through an aperture in the other panel member thereby impaling a sheet of planar material therebetween. However, as this known device is made from a metal, it is disadvantageous in terms of cost. In addition, such a display clip is disadvantageous from the standpoint that it is difficult to pull the first and second panels far enough apart from each other to enable a ready removal and replacement of the held sheet of material with another sheet. In addition, the known clip does not have a means for securing the sheet in place by locking the lance of the first panel to the panel having the aperture.

Accordingly, it has been considered desirable to develop a new and improved holder for planar or sheet material which would overcome the foregoing difficulties and others while providing better and more advantageous overall results.

BRIEF SUMMARY OF THE INVENTION

In accordance with the present invention, a holder for planar material is provided.

More particularly in accordance with the invention, the holder comprises a first panel, a second panel and a hinge along which the first panel is pivotably secured to the second panel. A first prong ms secured to the first panel and extends in a direction substantially normal to a plane of the first panel. A first aperture is provided in the second panel. The first prong of the first panel passes through an associated planar material and enters the first aperture of the second panel when the first panel is rotated along the hinge to a position in which the first panel overlies a portion of the second panel thereby securing the associated planar material between the first and second panels.

In accordance with another aspect of the present invention, the holder further comprises a means for holding the first prong in the second panel. Preferably, the means for holding can comprise a shoulder defined on the first prong and a shoulder defined on the second panel adjacent the first aperture. The shoulders contact each other to form the means for holding. Preferably, a means for securing the second panel to an associated support structure is also provided. The means for securing can comprise a first arm extending from the first panel and a second arm extending from the second panel, the second arm being spaced from the first arm. The first and second arms can extend rearwardly from the second panel and each of the arms can have at a free end thereof a flange which is adapted to cooperate with a C-channel of the associated support structure.

Preferably, the first and second panels, the hinge and the prong are of one piece and may comprise a thermoplastic material. The holder can further comprise a support leg extending from the second panel, the support leg supporting the holder on an associated surface. The holder can further comprise a second prong located on the first panel in the spaced manner from the first prong and a second aperture located in the second panel in a spaced manner from the first aperture. The second prong of the first panel passes through the associated planar material and enters the second aperture of the second panel when the first panel is rotated along the hinge so that the first panel overlies a portion of the second panel thereby holding the associated planar material between the first and second panels.

The holder can further comprise a support base from which the first and second panels extend. In one embodiment, the support base comprises a support panel having a first edge and a second edge, a first anchor arm extending from the first edge of the first support panel and a second anchor arm extending from the second edge of the support panel.

One advantage of the present invention is the provision of a new and improved holder or clip for planar material, such as sheets of advertising material or a wall of a box.

Another advantage of the present invention is the provision of a holder for planar material which holder includes first and second panels that are hingedly connected.

Still another advantage of the present invention is the provision of a holder in which a prong is located on a first panel and extends into an aperture located on the second panel and a means is provided for holding the prong to the second panel so that the planar material can be securely held.

Yet another advantage of the present invention is the provision of a sheet material holder including first and second panels that are hingedly connected to each other as well as a means for securing one of the panels to an associated support structure. The support structure may be a C-channel of a store shelf or a planar surface.

A further advantage of the present invention is the provision of a sheet material holder which includes at least a pair of spaced prongs secured to a first panel and extending into respective apertures in a hinged second panel so as to hold one or more sheets of material to the clip.

A still further advantage of the present invention is the provision of a holder for planar material wherein the holder can secure a box or the like to the front edge of a store shelf.

An additional advantage of the present invention is the provision of a sheet material holder which can be so designed that it is supported on a subjacent surface and displays a sheet at an acute angle to the subjacent surface, so that the sheet is readily visible to passers-by.

A yet further advantage of the present invention is the provision of a holder for sheet material which can be designed so that it is oriented either parallel to the front edge of a shelf or perpendicular to the front edge of a shelf.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts several embodiments of which will be described in detail in this specification and illustrated in the accompanying drawings which form a part hereof and wherein:

FIG. 5A is a perspective view of a holder for planar material according to a second embodiment of the present invention;

FIG. 5B is a front elevational view of a portion of the holder of FIG. 5A being mounted on a banner hanger;

FIG. 5C is a front elevational view of a portion of the holder of FIG. 5A being mounted on a suction cup;

FIG. 6 is a perspective view of a holder for planar material according to a third embodiment of the present invention;

FIG. 7 is a perspective view of the holder of FIG. 6 being employed to secure a plurality of sheets together;

FIG. 8 is a perspective view of a holder for planar material according to a fourth embodiment of the present invention;

FIG. 9 is a perspective view of a holder for planar material according to a fifth embodiment of the present invention;

FIG. 10 is a perspective view of the holder of FIG. 9 on a reduced scale being used to secure a plurality of sheets together;

FIG. 11 is a perspective view of a holder for planar material according to a sixth embodiment of the present invention;

FIG. 12 is a perspective view of the holder of FIG. 11 on a reduced scale being mounted in a C-channel of a shelf to hold a planar wall of a box;

FIG. 13 is a perspective view of a holder for planar material according to a seventh embodiment of the present invention; and, FIG. 14 is a perspective view of the holder of FIG. 13 on a reduced scale being used to hold a sheet of material.

DETAILED DESCRIPTION OF THE PREFERRED EMBODIMENTS

Figure 1:
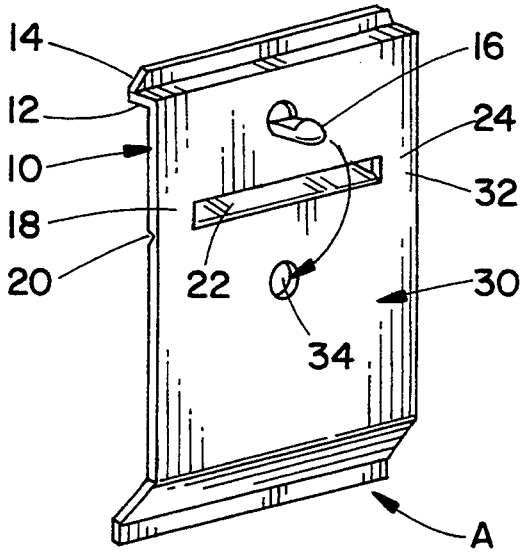
FIG. 1 is a perspective view of a holder for planar material according to one embodiment of the present invention.

Referring now to the drawings wherein the showings are for purposes of illustrating several preferred embodiments of the invention only and not for purposes of limiting same, FIG. 1 shows a holder A for planar material. While the holder is primarily designed for and will hereinafter be described in connection with a retail environment in which a sheet of material is displayed to purchasers, it should be appreciated that the holder can also be used in other environments. For example, the holder can be used to secure a set of sheets together or to hold a box to a shelf.

Figure 4:
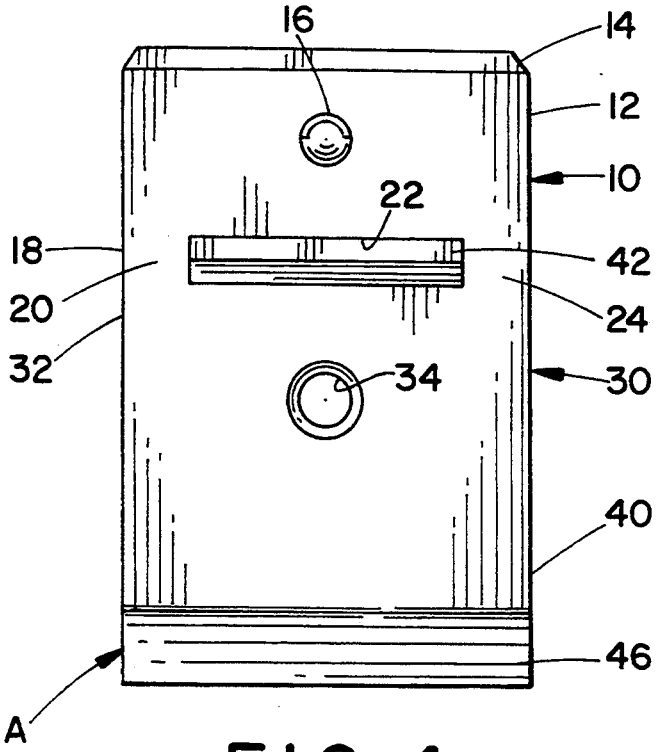
FIG. 4 is a front elevational view of the holder of FIG. 3.

With reference now to FIG. 4, the holder A comprises a first panel 10 having a first end edge 12 on which is located a tab portion 14. The first panel 10 further comprises a preferably integral prong 16 which extends substantially normal to the plane of the first panel. The first panel further comprises a second end edge 18 along which is defined a first hinge section 20, a slot 22 and a second hinge section 24. As is evident, the slot 22 spaces the first and second hinge sections from each other so that these are located adjacent the two side edges of the first panel. The hinge sections 20 and 24 connect the first panel 10 to a second panel 30 along a first end edge 32 thereof.

Figure 3:
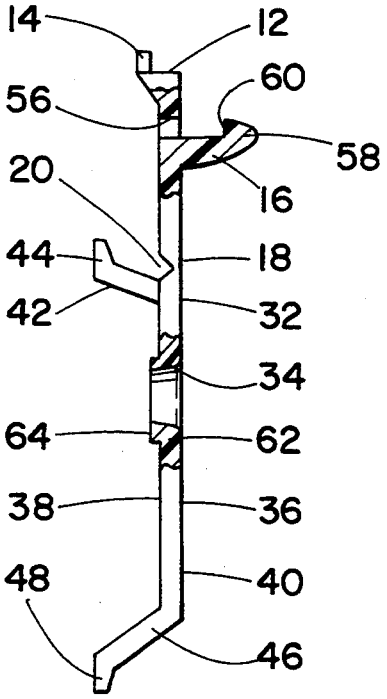
FIG. 3 is an enlarged side elevational view, partially in cross section, of the holder of FIG. 1.

With reference now also to FIG. 3, located in the second panel 30 is an aperture 34 which extends from a front face 36 to a rear face 38 thereof. Further provided on the second panel 30 is a second end edge 40. Extending from the rear face 38 of the second panel 30, adjacent the first end edge 32 thereof, is a first anchor arm 42 which terminates in a flange 44. Extending from the second end edge 40 of the second panel 30 is a second anchor arm 46 which terminates in a second flange 48.

It can be seen from FIG. 3 that the first and second anchor arms extend at an acute angle to the plane of the second panel 30 with the pair of flanges 44, 48 extending away from each other at an acute angle to the plane of the first and second anchor arms 42, 46. It is also noted that the plane of the first and second flanges 44, 48 is parallel to the plane of the second panel 30. If the hinges 20, 24 have not been employed, the first and second panels 10, 30 lie in the same plane as shown in FIG. 1. When the first panel 10 is pivoted on the hinges, it is caused to overlie the second panel 30 as shown in FIG. 2.

The prong 16 located on the first panel 10 includes an enlarged head 58 defined by a shoulder 60. The aperture 34 in the second panel 30 is tapered from the front surface 36 to the rear surface 38 of the second panel. The aperture extends through a thickened section 62 of the second panel so as to form a shoulder 64 on the second panel rear surface 38. The prong 16 is so sized and located in relationship to the aperture 34 that when the first panel 10 is rotated towards the second panel 30, the prong will enter the aperture as is evident from FIG. 2 of the drawings. To lock the first panel 10 to the second panel 30, the prong shoulder 60 engages the shoulder 64 on the second panel thickened section 62.

Preferably, the holder A is of one piece such that the first and second panels 10, 30, the two hinge sections 20 and 24 and the prong 16 are of one piece. These elements can be made of a single piece of resilient material such as a plastic. To this end, the holder A may be manufactured by injection molding from a suitable thermoplastic material such as polypropylene.

Figure 2:
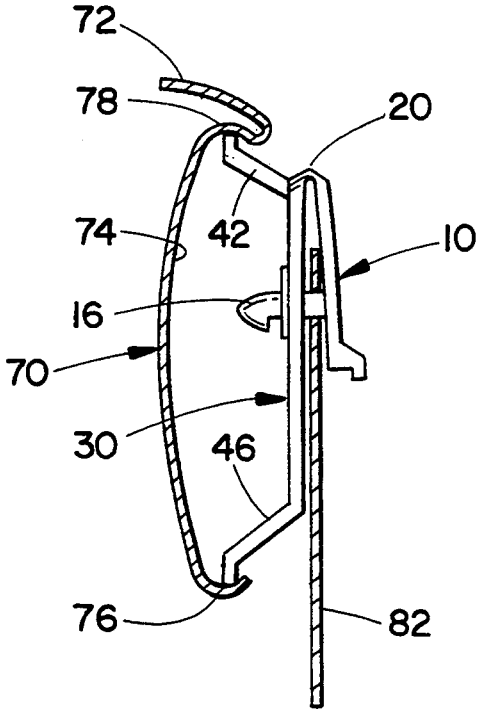
FIG. 2 is a side elevational view of the holder of FIG. 1 mounted in a C-channel of the type commonly found secured to the front edge of a retail store shelf.

With reference now also to FIG. 2, the holder A is particularly adapted to fit into a C-channel 70 that is normally found secured to the front edge of a retail store shelf. The C-channel 70 may comprise a strip of some type of metallic material which is formed into a channel 74 defined by first and second spaced flanges 76, 78. When the first panel 10 is rotated around the hinges 20 and 24 toward the second panel 30, the prong 16 thereof will enter the aperture 34 and extend therethrough. If a sheet of planar material 82 is brought adjacent the second panel 30 before the first panel is rotated, then the prong 16 will pierce the sheet and subsequently enter the aperture 34 of the second panel. In this way, the sheet 82 is secured to the holder or clip A. Once this is accomplished, the holder A can be mounted in the C-channel 70 such that the first and second anchor arms 42, 46 of the holder A contact the first and second flanges 76, 78 of the C-channel 70.

To disengage the prong 16 from the second panel 30 when the sheet 82 is to be removed, one merely needs to pull on the tab 14 of the first panel. Due to the resiliency of the material from which the holder A is manufactured, the prong 16 will be pulled in such a manner as to disengage the shoulder 60 from the shoulder 64. Thereafter, the first panel 10 can be rotated around the hinge 20, 24 in relation to the second panel 30 so as to remove the prong 16 from the aperture 34. Thereafter, the sheet 82 can be removed and, if desired, replaced with another sheet.

It should be appreciated from FIG. 3 that the first anchor arm 42 is narrower in width than the second anchor arm 46. More specifically, the width of the first arm 42 is substantially equal to the width of the slot 22 formed between the first and second panels. In contrast, the second arm 46 is as wide as the panel 30, as is evident from FIG. 4.

With reference now to FIG. 5A, another holder B is there illustrated. In this embodiment, the holder B comprises a first panel 90 extending from which is a prong 92 in a plane substantially normal to the plane of the panel. A hinge 94 connects the first panel 90 to a second panel 96. The second panel has an aperture 98 extending therethrough. The prong 92 is adapted to seat in the aperture 98 when the first panel. 90 is rotated along the hinge 94 in relation to the second panel 96. When this is done, a frame section 100 is exposed. The frame 100 is of one piece with the second panel 96. It can be seen, therefore, that the second panel 96 has an approximately diamond shaped appearance. Since the first panel 90 is substantially triangular in shape, the first panel, when it is rotated around the hinge 94, leaves behind a substantially triangular opening 102 defined by the frame section 100 and the hinge 94 which connects the first and second panels 90, 96. When this is done a suitable securing means can extend through such opening 102.

With reference to FIG. 5B, one such suitable securing means can be a string 104 such as from a conventional banner hanger or the like.

With reference now to FIG. 5C, another suitable securing means for the holder B can be a conventional suction cup 106. In this embodiment, an enlarged head 108 of the suction cup supports the frame section 100 and hence the holder B.

As with the embodiment of FIGS. 1–4, the holder B can be manufactured from a suitable resilient material such as a thermoplastic or the like in such a manner that the holder is of one piece. The holder can be utilized to hold a sheet of advertising material or the like. The material can, as is known by those of average skill in the art, be made of paper, plastic or fabric (or perhaps even sheet metal if a hole is punched where the prong is expected to extend through) and can be advertising or display material useful in a retail store setting.

With reference now to FIG. 6, still another embodiment of a holder C is there illustrated. In this embodiment, the holder comprises an elongated first panel 110 having thereon a first prong 112, a second prong 114 and a third prong 116. The three prongs are spaced from each other and extend substantially normal to the plane of the first panel 110. The first panel is connected by a hinge 118 to an elongated second panel 120. The second panel has extending therethrough suitable apertures 122, 124 and 126 which are so spaced along the second panel as to accommodate the first, second and third prongs 112, 114, 116 of the first panel when the first panel 110 is rotated around hinge 118 in relation to the second panel 120.

With reference now to FIG. 7, the holder C can be used to accommodate a stack 122 comprising a plurality of aligned sheets 124 of a material such as paper. With a stack 122 of aligned sheets 124, placed in the open holder C illustrated in FIG. 6, the first panel 110 can be rotated in relation to the second panel 120 along the hinge line 118 such that the series of prongs 112, 114, 116 pierce the sheets 124 and subsequently enter the series of aligned apertures 122, 124, 126 provided in the second panel 120. As mentioned with regard to the embodiment of FIGS. 1–4, a means is provided for securing the prongs 112, 114, 116 to the second panel 120. In this way, the stack of sheets is held together by the holder C.

With reference now also to FIG. 8, yet another holder D is there illustrated. The holder D comprises a first panel 130 having an integral prong 132 extending therefrom. The first panel is secured along a hinge 134 to a second panel 136. The second panel has extending therethrough an aperture 138 which is so located and sized that when the first panel 130 is pivoted around the hinge 134, the prong 132 is accommodated in the aperture 138. In this embodiment, at least one of the first and second panels 130, 136 is secured to a support panel 140.

In the embodiment of FIG. 8, second panel 136 is secured along an edge adjacent the hinge 134 to a side edge of the support base. The support base can comprise a panel 140 that has a first end edge 142 along which is located a first anchor arm 144 and a second end edge 146 along which is located a second anchor arm 148. The anchor arms 144 and 148 are suitably sized and shaped so as to be accommodated in a C-channel along the lines illustrated in FIG. 2 of the drawings. In contrast to the holder A of FIG. 2, which holds the sheet 82 parallel to the plane of the C-channel 70, the holder D of FIG. 8 will hold a sheet substantially normal to the plane of the C-channel. Preferably, the first and second panels 130, 136 and the support panel 140 are of one piece. The holder D can, for example, be manufactured, as by injection molding, from a suitable thermoplastic material, such as polypropylene.

With reference now to FIG. 9, yet another holder E is there illustrated. This holder comprises a first panel 150 extending normal to which is an integral prong 152.

The first panel is secured along a hinge line 154 to a second panel 156. Provided in the second panel is an aperture 158 that is suitably located and sized as to accommodate the prong 152 when the first panel 150 is rotated around the hinge 154 in relation to the second panel 156.

With reference now to FIG. 10, the holder E is meant to accommodate a stack 160 comprising a plurality of aligned sheets 162. The holder E functions like a paper clip or staple to secure the stack of sheets together. Sheets from the stack can be removed simply by rotating the first panel 150 in relation to the second panel 156 once the prong 152 is no longer in contact with the back side of the second panel 156. The means for securing the prong 152 to the back side of the second panel 156 is identical to the means which has been described with regard to the embodiment of FIGS. 1–4.

With reference now to FIG. 11, yet another type of holder F is there disclosed. This holder comprises a first panel 170 including spaced first and second prongs 172,174 which extend substantially normal to the panel 170. Defined along one edge of the panel are a first hinge section 176, a slot 178 and a second hinge section 180. These separate the first panel 170 from a second panel 182. Extending through the second panel are spaced first and second apertures 184, 186 which are so located and sized as to accommodate the first and second prongs 172, 174.

Extending from the second panel 182 are first and second anchor arms 188, 190. With reference now to FIG. 12, these arms are so located and sized as to fit into a C-channel 192 such that the anchor arms 188, 190 cooperate with a pair of spaced flanges 194, 196 which define a channel 198.

The holder F can be used to support a box 200 which contains a dispensing opening 202. A rear wall 204 of the box can be provided with a pair of spaced apertures 206, 208. These apertures are aligned with the apertures 184, 186 in the second panel 182. When the box 200 is abutted against the second panel 182 and the respective apertures 184, 206 and 186, 208 are aligned, the prongs 172, 174 on the first panel 170 can then enter the two sets of aligned apertures when the first panel is rotated around the hinges 176, 180 until the first panel 170 overlies the second panel 182. Once this is accomplished, the prongs 172, 174 lock to the second panel 182 and the box 200 is secured to the C-channel 192.

Finally, with reference to FIG. 13, yet another holder G is there illustrated. In this embodiment, the holder comprises a first panel 220. Extending normal to the first panel is a prong 222. The first panel 220 is secured along the hinge line 224 to a second panel 226. Located in the second panel is an aperture 228 which is suitably sized and positioned so as to accommodate the prong 222 when the first panel 220 is rotated in relation to the second panel 226. Secured to the second panel 226 is a support leg 230. The support leg will allow the holder G to be supported by a subjacent support surface. As in the previous embodiments, the holder G is preferably made from a suitable thermoplastic material and is preferably of one piece.

The holder G is useful for holding a point of sale display sign or sheet 232 such as in a retail environment. As in the previous embodiments, when the sheet 232 needs to be replaced, the prong 222 is unlocked from the second panel 226 and the first panel is rotated away from the second panel. Then the sheet 232 can be removed and replaced with another suitable sheet. This would then allow the holder G to be utilized again.

The invention has been described with reference to several embodiments. Obviously, modifications and alterations will occur to others upon a reading and understanding of this specification. It is intended to include all such modifications and alterations insofar as they come within the scope of the appended claims or the equivalents thereof.

What is claimed is:

1. A holder for planar material, comprising:
- a first panel;
- a second panel;
- a hinge along which said first panel is pivotably secured to said second panel;
- a first prong secured to said first panel and extending in a direction substantially normal to a plane of said first panel;
- a first aperture in said second panel, wherein said first prong of said first panel passes through an associated planar material and enters said first aperture of said second panel when said first panel is rotated along said hinge to a position in which said first panel overlies a portion of said second panel thereby securing the associated planar material between said first and second panels; and,
- a means for holding said first prong in said second panel wherein said means for holding comprises:
- a shoulder defined on said first prong, and
- a shoulder defined on said second panel adjacent said first aperture, said shoulders contacting each other to form said means for holding.

2. The holder of claim 1 further comprising a support base to which at least one of said first and second panels is secured.

3. The holder of claim 2 wherein said support base comprises:
- a support panel having a first edge and a second edge;
- a first anchor arm extending from said first edge of said support panel; and,
- a second anchor arm extending from said second edge of said support panel.

4. The holder of claim 1 further comprising a means for securing the second panel to an associated support structure.

5. The holder of claim 4 wherein said means for securing comprises:
- a first arm extending from said second panel; and,
- a second arm extending from said second panel, said second arm being spaced from said first arm.

6. The holder of claim 5 wherein said first an second arms extend rearwardly from said second panel.

7. The holder of claim 5 wherein each of said first and second arms includes at a free end thereof a flange, said flange being adapted to cooperate with a C-channel of the associated support structure.

8. The holder of claim 1 wherein said first and second panels, hinge and prong are of one piece.

9. The holder of claim 8 wherein said first and second panels, hinge and prong comprise a thermoplastic material.

10. The holder of claim 1 further comprising a support leg extending from said second panel, said support leg supporting the holder on an associated surface.

11. The holder of claim 1 further comprising:
- a second prong located on said first panel in a spaced manner form said first prong; and, a second aperture located in said second panel in a spaced manner from said first aperture, wherein said second prong of said first panel passes through the associated planar material and enters said second aperture of said second panel when said first panel is rotated along said hinge so that said first panel overlies a portion of said second panel thereby holding the associated planar material between said first and second panels.

12. A one piece holder for sheet material, comprising:

a first panel;

a second panel hingedly secured to said first panel along a hinge defined between said first and second panels;

a first prong secured to said first panel and extending in a direction substantially normal thereto;

a first aperture in said second panel, wherein said first prong of said first panel passes through an associated sheet material and enters said first aperture of said second panel when said first panel is rotated around said hinge to a position in which said first panel overlies a portion of said second panel thereby holding the associated sheet material between said first and second panels; and, a means for holding said first prong in said second panel, wherein said means for holding comprises:

a shoulder defined on said first prong, and a shoulder defined on said second panel adjacent said first aperture, said shoulders contacting each other to form said means for holding.

13. The holder of claim 12 further comprising a means for securing at least one of the first and second panels to an associated support structure.

14. The holder of claim 12 wherein said means for securing is located on said second panel and comprises a first arm extending from said second panel and a second arm extending from said second panel, said second arm being spaced from said first arm wherein said first and second arms are adapted to cooperate with a C-channel of an associated support structure.

15. The holder of claim 12 further comprising a support base from which said first and second panels extend.

16. The holder of claim 12 further comprising a means for securing the second panel to an associated support structure, wherein said means for securing comprises:

a first arm extending at an acute angle from said second panel; and, a second arm extending at an acute angle from said second panel, said second arm being spaced from said first arm, wherein each of said first and second arms includes at a free end thereof a flange, said flange being adapted to cooperate with a C-channel of the associated support structure.

17. The holder of claim 15 wherein said support base comprises a planar leg secured to said second panel member and extending at an acute angle therefrom, said leg supporting the holder on an associated support surface.

18. The holder of claim 15 wherein said support base comprises:

a support panel having a first edge and a second edge;

a first anchor arm extending from said first edge of said support panel; and, a second anchor arm extending from said second edge of said support panel.

19. A holder for planar material, comprising:

a first panel;

a second panel hingedly secured to said first panel along a hinge defined between said first and second panels;

a first prong secured to said first panel and extending in a direction substantially normal thereto, said prong having a pointed tip and a shoulder defined rearwardly of said tip;

a first aperture in said second panel, wherein said pointed tip pierces an associated planar material so that said first prong of said panel can pass through the planar material and enter said first aperture of said second panel when said first panel is rotated around said hinge to a position in which said first panel overlies a portion of said second panel thereby holding the associated planar material between said first and second panels, wherein said holder is of one piece and comprises a resilient material to allow said first and second panels to be selectively rotated in relation to each other around said hinge; and, wherein said shoulder defined on said first prong cooperates with a rear side of said second panel to hold said first prong in said second panel.

20. The holder of claim 19 further comprising a support leg extending from one of said first and second panels, said support leg supporting the holder on an associated surface.

21. The holder of claim 19 wherein said rear side of second panel comprises a raised shoulder located adjacent said first aperture, said panel shoulder cooperating with said shoulder defined on said first prong.

22. The holder of claim 19 further comprising a means for securing at least one of said first panel and said second panel to an associated support structure.

23. The holder of claim 19 further comprising:

a second prong located on said first panel in a spaced manner form said first prong; and, a second aperture located in said second panel in a spaced manner from said first aperture, wherein said second prong of said first panel passes through an associated planar material and enters said second aperture of said second panel when said first panel is rotated along said hinge so that said first panel overlies a portion of said second panel thereby holding the associated planar material between said first and second panels.

* * * * *